United States Patent [19]

Seaborn et al.

[11] 4,047,544

[45] Sept. 13, 1977

[54] WIRE FORMING APPARATUS

[75] Inventors: Paul Edward Seaborn, Los Gatos; Kenneth Harold Dawson, Newark, both of Calif.

[73] Assignee: The Mead Corporation, Dayton, Ohio

[21] Appl. No.: 754,243

[22] Filed: Dec. 27, 1976

[51] Int. Cl.[2] ..... B21F 1/04

[52] U.S. Cl. ..... 140/105; 72/191

[58] Field of Search ..... 140/71 R, 105, 90; 72/191

[56] References Cited

U.S. PATENT DOCUMENTS

| | | | |
|---|---|---|---|
| 2,188,407 | 1/1940 | Horton | 140/90 |
| 2,640,663 | 6/1953 | Leland | 242/155 R |
| 3,556,166 | 1/1971 | Whitney | 140/71 R |
| 3,805,579 | 4/1974 | Calvert et al. | 140/105 |

*Primary Examiner*—Lowell A. Larson

[57] ABSTRACT

This invention relates to an improved wire forming apparatus of the type wherein a pair of rotatable wheels are disposed alongside of each other, a plurality of pins are secured to each of the wheels about the periphery thereof, and mounting means rotatably support the wheels in such a manner that their axes of rotation are angularly disposed to each other. The improvement herein comprises looping means disposed adjacent to the peripheries of the rotatable wheels, the looping means being discontinuously rotatable about a central axis. The central axis of the looping means is offset from and parallel to a plane defined by the plurality of pins secured to either of the wheels about the periphery thereof. The looping means intermittently engage a strand of wire and impart an undulatory configuration thereto. In addition, pushing means are integrally disposed adjacent the looping means for transferring a looped strand of wire from the looping means to one of the pins disposed about the periphery of the rotatable wheels. The pushing means comprise at least two individual pushing members, the pushing means and the looping means being aligned and operating in cooperative relationship with one another.

5 Claims, 18 Drawing Figures

WIRE STRETCHING ASSEM.
WIRE LOOPING ASSEMBLY
INPUT WIRE GUIDE
STRAIGHTNER-2
STRAIGHTNER-1
TENSIONER SEE FIG. 6
FROM WIRE SUPPLY

FIG. 8
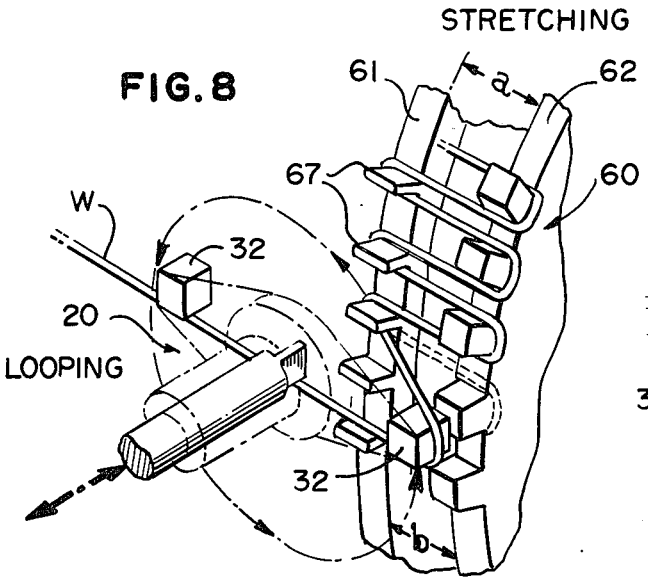
FIG. 9
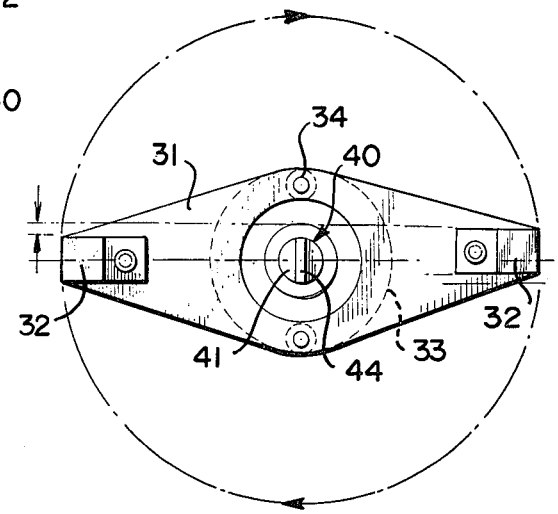
FIG. 10
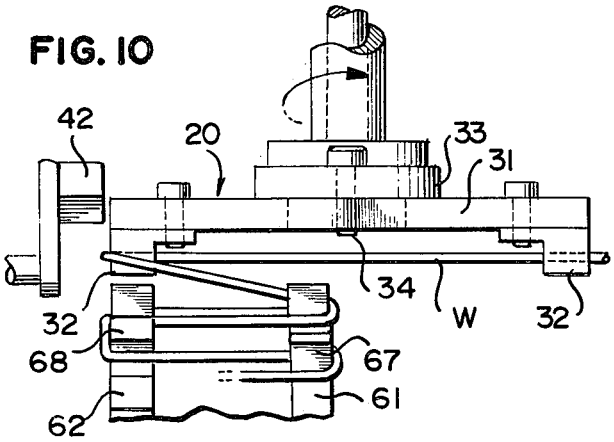
FIG. 12
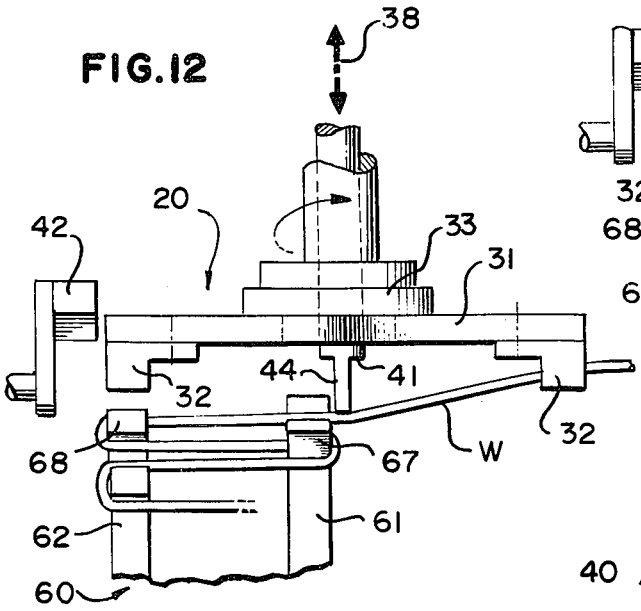
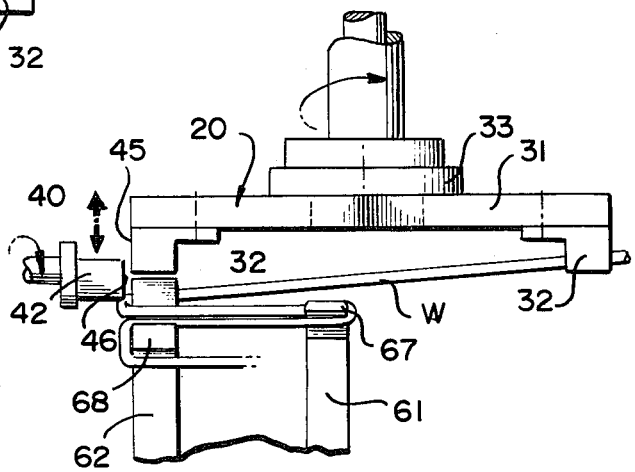
FIG. 11

WIRE FORMING APPARATUS

BACKGROUND OF THE INVENTION

A. Subject Matter

This invention relates to apparatus for imparting an undulatory configuration to a strand of wire.

B. Prior Art

This invention comprises an improvement over known apparatus for imparting an undulatory configuration to a strand of wire. Prior to this invention, and to the invention over which this is an improvement, machines were known for imparting an undulatory configuration to a strand of wire which conventionally utilized a pair of serrated complimentary dyes for engaging the wire and bending it into the desired configuration. Such devices are necessarily reciprocal in nature and hence are characterized by high inertia and inherent low operating speed. Such known dye devices are not only expensive to build but require a substantial maintenance effort if a satisfactory product is to be formed.

In this respect major efforts have been directed to the development of apparatus and methods for imparting an undulatory configuration to a strand of wire wherein reciprocal parts are eliminated and rotatable elements are used instead. In an initial effort to accomplish such a desired result a pair of wheels were disposed along side each other and rotatably mounted on axes which were angularly disposed so that a plurality of pins disposed about the peripheries of both wheels were caused to occupy spaced relationships which continuously varied throughout each revolution of the wheel. This space variation allowed rapid formation of loops of wire about the pins followed by a tightening of the loops due to increased spacing between the particular pin on one wheel and the adjacent pin on the other wheel. Thus a permanent set was imparted to the wire according to this particular feature of the invention which involved the angular displacement of the rotating wheels. Various mechanisms for securing the wire in place on the rotating wheels and for removing the wire are provided in accordance with specific features of the apparatus of the prior art. See in particular U.S. Pat. No. 3,691,808 issued Sept. 19, 1972 to Calvert et al.

While the above recited Calvert et al. patent does disclose the use of angularly disposed rotatable wheels having a plurality of pins secured to the periphery of each of said rotatable wheels to impart an undulatory configuration to a strand of wire a disadvantage of the apparatus of Calvert et al. is in what is referred to hereinafter as the wire looping assembly. The wire looping assembly of the Calvert et al. patent comprises a rotatable device having lateral projecting arms thereon engaging the wire as the wire is fed into the wire looping assembly and subsequently loops the wire about a pair of pins disposed respectively on the peripheries of a pair of rotatable wheels. This wire looping assembly and specifically the rotatable element with the arms disposed thereon has led to serious commercial difficulties in terms of maximum operating speed and downtime for repairs. In addition this rotatable element comprising the primary element of the wire looping assembly is difficult to mechanically actuate as it requires a discontinuous action which is not easily converted from standard drive means. In addition the wire forming apparatus of the Calvert et al. patent requires releasing means to operate by an oscillating motion to periodically displace the strand of wire from contact with the rotating element. All of these elements which comprise the commercial limiting elements of the entire wire forming apparatus have been eliminated and/or improved by applicants' invention.

Brief Description of the Drawings

FIG. 8 is an enlarged perspective view of certain principle components of this invention as shown in FIG. 1;

FIG. 9 is an enlarged front view of portions of the wire looping assembly and wire pushing assembly of this invention;

FIG. 10 is a top view of portions of the pushing, stretching and looping assemblies of this invention showing in particular the outside pushing member in the retracted position;

FIG. 11 is a view substantially identical to the view shown in FIG. 10 with the exception that the outside pushing member is in the extended position;

FIG. 12 is a view substantially identical to the views shown in FIGS. 10 and 11 with exception that the outside pushing member is in the retracted position and the inside pushing member is in the extended position;

SUMMARY OF THE INVENTION

Figure 1:
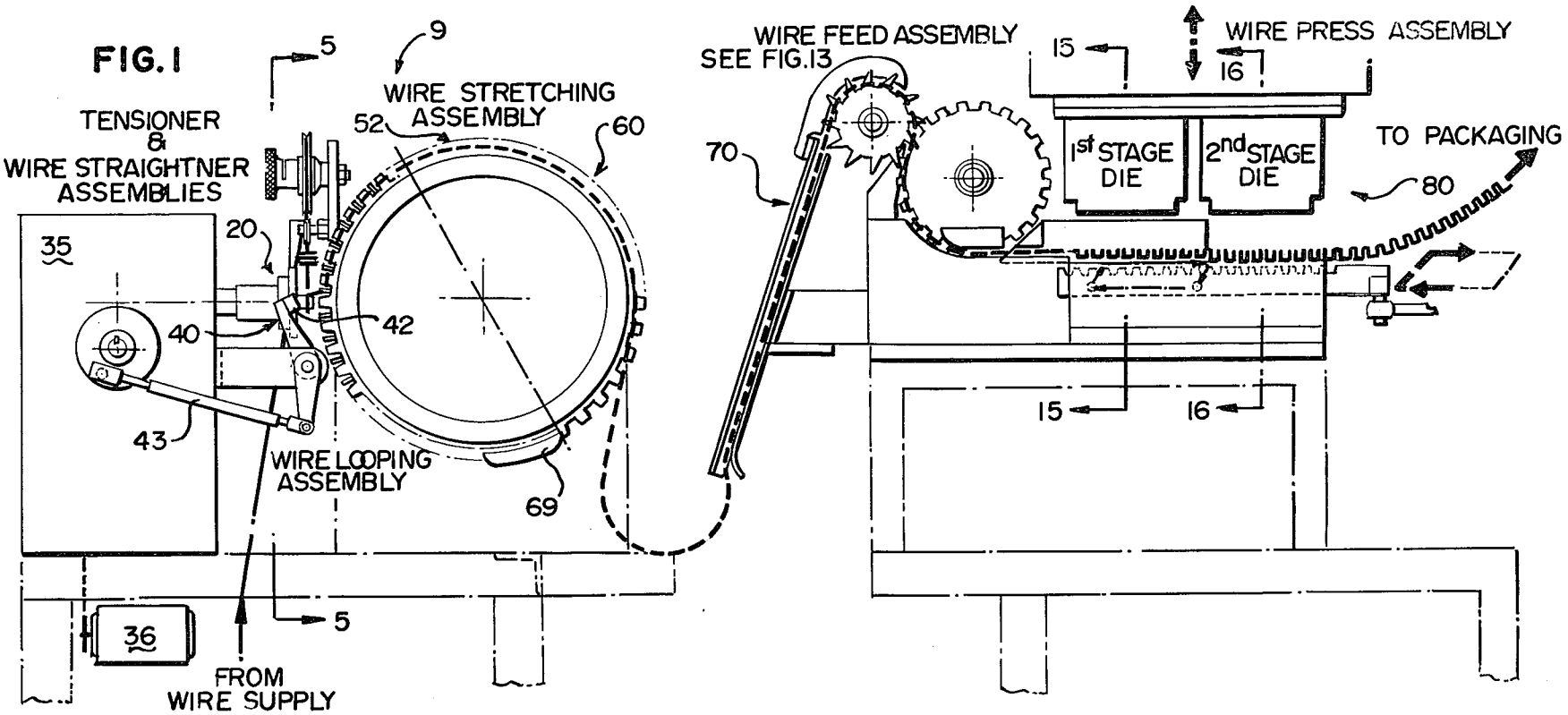
FIG. 1 is an overall schematic front view of a machine constructed according to this invention.

This invention relates to an improved wire forming apparatus of the type wherein a pair of rotatable wheels are disposed alongside of each other, a plurality of pins are secured to each of the wheels about the periphery thereof, and mounting means rotatably support the wheels in such a manner that their axes of rotation are angularly disposed to each other. The improvement herein comprises looping means disposed adjacent to the peripheries of the rotatable wheels, the looping means being discontinuously rotatable about a central axis. The central axis of the looping means is offset from and parallel to a plane defined by the plurality of pins secured to either of the wheels about the periphery thereof. The looping means intermittently engage a strand of wire and impart an undulatory configuration thereto. In addition, pushing means are integrally disposed adjacent the looping means for transferring a looped strand of wire from the looping means to one of the pins disposed about the periphery of the rotatable wheels. The pushing means comprise at least two individual pushing members, the pushing means and the looping means being aligned and operating in cooperative relationship with one another.

DETAILED DESCRIPTION OF THE PREFERRED EMBODIMENT

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further application of the principles of the invention as illustrated therein contemplated as would normally occur to one skilled in the art to which the invention relates.

Referring now more particularly to the drawings, the improved wire forming apparatus 9 comprises a wire tension assembly 10, a wire looping assembly 20, a wire pushing assembly 40, a wire stretching assembly 60, a wire feed assembly 70 and a wire press assembly 80.

The wire tension assembly 10 comprises a disc brake 11, said disc brake 11 affording an adjustable frictional drag resistance against the feeding of a strand of wire W to facilitate the most desirable input of wire into the actual wire forming apparatus. For most applications an adjustable frictionaldrag resistance of from about 1 to about 30 pounds is considered acceptable although this is by no means considered an absolute range. Any of a variety of factors including size of the tension assembly 10 can be used to control the range of tension considered useful for the particular type of wire or speed of operation. It is important to notethat the tension assembly 10 must be specifically designed to accommodate the wire being processed. In particular, many common commercial wires are coated with tin. This coating can be easily rubbed off with resulting deterioration of the wire if tension is not applied in a fashion consistent with the chemical and physical composition of the wire W.

Figures 5, 6, 7:
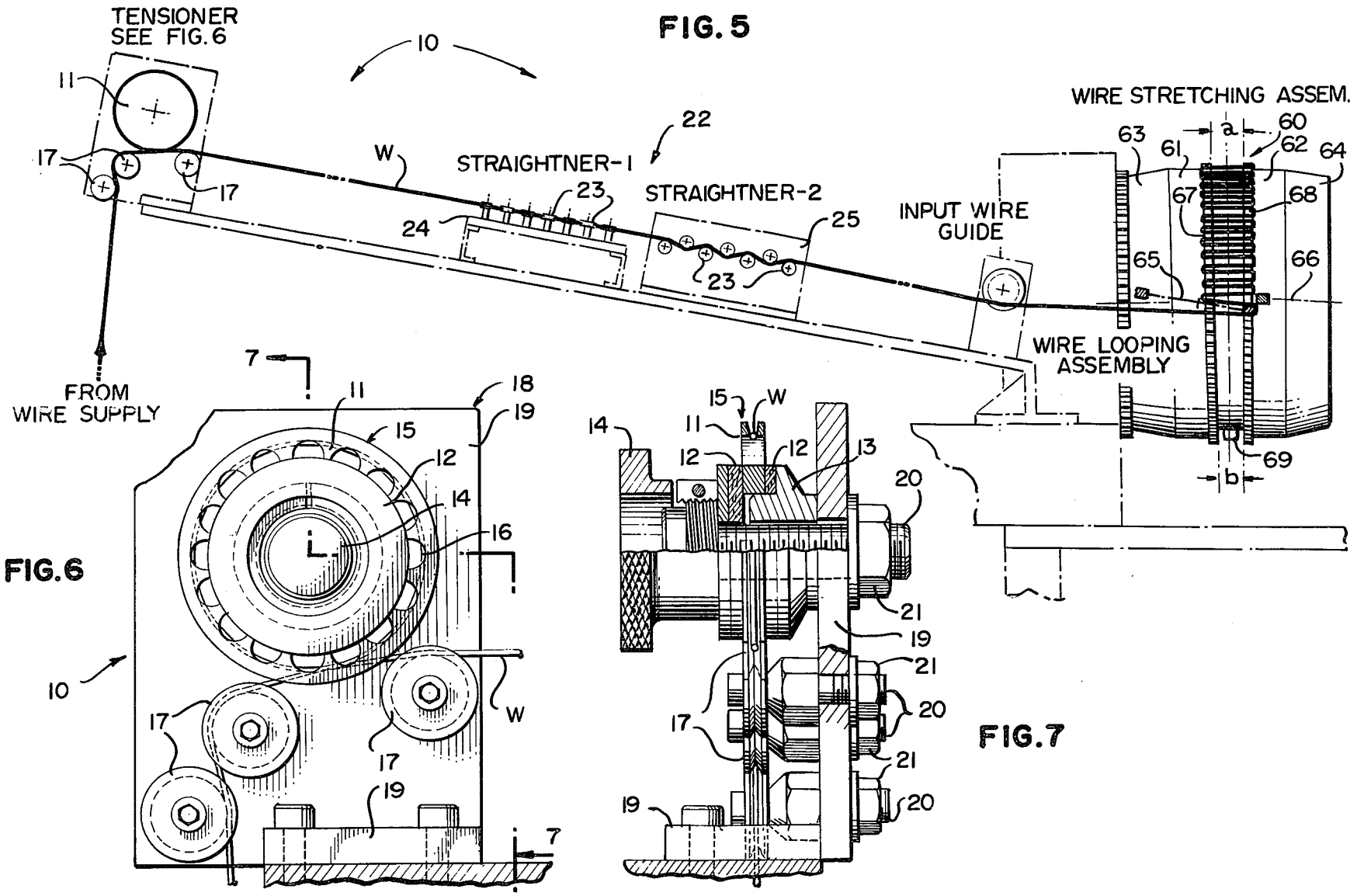
FIG. 5 is a schematic view showing the relationship of the wire tension assembly and the wire stretching assembly with the wire looping assembly removed.
FIG. 6 is front view of the wire tension assembly of this invention.
FIG. 7 is a side view of the wire tension assembly of this invention taken along line 7—7 in FIG. 6 and viewed in the direction of the arrows.

The frictional drag resistance of disc brake 11 is contolled by friction members 12 located on either side of disc brake 11. Referring now more particularly to FIGS. 6 and 7 it can be seen that a spring washer 13 sometimes more commonly known as a Bellville spring washer abuts against one of said friction members 12. Opposite to said spring washer 13 and abutting against the opposite friction member 12 is knurled knob 14 providing convenient manual adjustment of disc brake 11. Disc brake 11 is characterized by having a groove 15 cut in its periphery. As was developed supra it is important that groove 15 cut in the periphery of disc brake 11 be of a configuration that prevents "stripping" of material coated on the wire W. For purposes of most wires used in the binding of notebooks and the like a diameter of from about 0.031 to about 0.047 inch across the bottom of groove 15 is sufficient. In addition vents 16 are spaced around the interior of the circumference of disc brake 11 to provide convenient cooling to disc brake 11.

The strand of wire W is threaded through a series of guide wheels 17, three of which are shown in the accompanying drawings, in order to stabilize the strand of wire W prior to and after contact with disc brake 11. Although three guide wheels 17 are shown in the accompanying drawings any number desired can be used. In addition it should be noted that groove 15 in the periphery of disc brake 11 is arcuately configured such that the bottom most surface of groove 15 is rounded such that the diameter of the wire W permits the maximum contact between the wire W and the surface of V-shaped groove 15. This contact provides for maximum efficiency in frictional resistance as has been developed hereinabove.

Mounting means 18 are provided for attaching the disc brake 11 and guide wheels 17 to the wire forming apparatus 9. Any conventional mounting means 18 can be used and by way of example the drawings illustrate the use of a pair of rectangular metallic members 19 disposed at right angles to one another to which the wire tension assembly 10 is mounted by a variety of bolts 20 and nuts 21.

Upon leaving disc brake 11 and guide wheel **17*a* the strand of wire is then conveyed into wire straightener 22. Wire straightener 22 consists of a series of a plurality of grooved wheels 23 which are non-linearly aligned with one another, the wheels 23 being grouped as a first set 24 and a second set 25, the sets 24 and 25 being aligned at right angles as is more particularly shown in FIG. 5. In such alignment the wire W upon entering the wire straightener 22 is successively subjected to slight bending forces in several directions resulting in the linear configuration of said strand of wire upon leaving the wire straightener 22. The wire straightener 22** is a well-known piece of commercial apparatus and is readily available from a variety of commercial sources.

From the wire tension assembly 10 the strand of wire enters the wire looping assembly 30. The wire looping assembly 30 includes a forming arm 31 to which are attached a pair of forming dogs 32. The forming arm 31 is attached to central hub 33 by screws 34. Rotational movement of hub 33 and correspondingly forming arm 31 and forming dogs 32 is actuated by drive means 35. Drive means 35 is commercially referred to as a Ferguson gear box and is commercially available on a made to order basis. The Ferguson gear box consists of a variety of cams and gears which enable the predetermined discontinuous rotational movement of hub 33. The Ferguson gear box 35 is driven by conventional electrical or mechanical drive means which are given a number 36 but do not form a part of this invention.

Forming arm 31 includes grooves (not shown in the drawing) into which forming dogs 32 fit. Forming dogs 32 are then secured into grooves and onto forming arm 31 by conventional fastening means. The particular size and configuration of forming arm 31 and forming dogs 32 are a matter of convenience to the individual operator and may be changed according to the desired configuration of the final formed wire product. As can be seen more particularly in FIG. 9 the forming dogs 32 are linearly offset from one another. It has been found that if the offset is not present the wire W has a tendency to "miss" the small toothed forming ring. Offsets of from about 0.1 inch to about 0.15 inch and preferably 0.125 inch have been found acceptable although the offset is dependant on the particular wire and apparatus being used.

As can be seen more particularly in FIG. 8 the wire W upon entering the wire looping assembly 30 is grasped by a forming dog 32 as forming arm 31 and hub 33 are discontinuously rotated in a counterclockwise direction. As the wire W is grasped by the lowermost edge of the forming dog 32 nearest to the wire straightener 22 it is pushed downward while maintaining contact with said forming dog 32. As this discontinuously rotational movement continues each of the forming dogs 32 in turn grasp the wire W and causes it to rotate which in turn places it in the proper configuration for transfer to the wire stretching assembly 60. The transfer from the wire looping assembly 30 to the wire stretching assembly 60 is accomplished by use of the wire pushing assembly 40. It is important to note here that the central axis 38 of central pushing member 41 is offset from the plane defined by either of the plurality of teeth on either of the forming rings. A generally satisfactory offset has been found to be from about 0.03 to about 0.07 inches and preferably 0.05 inch although this can vary depending on the particular forming arm 31. Forming arm 31 can be in a variety of shapes including circular or oblong but more preferably is in the configuration illustrated by FIG. 9.

Referring now more particularly to FIGS. 10–12 the wire pushing assembly 40 is illustrated. In this, the preferred embodiment, the wire pushing assembly 40 includes a central pushing member 41 and an outside pushing member 42. The central pushing member 41 is actuated by the drive means 35 which form a part of the wire looping assembly 30. The central pushing member 41 extends through a hollow portion of the hub 33 and extends beyond the plane of forming arm 31. The central pushing member 41 operates by reciprocal motion being discontinuously actuated to an extended position (FIG. 12) or to a retracted position (FIG. 11) or a position intermediate the extended or retracted position. A raised central portion 44 of central pushing member 44 is shown more particularly in the view of forming arm 31 shown in FIG. 9. When the central pushing member 41 is in the extended position the raised central portion 44 intersects wire W and removes wire W from forming dog 32 and pushes it onto the small teeth located on the forming rings (see FIG. 12).

It is important to note that the central axis 38 of central pushing member 41 is offset slightly from the plane defined by either set of the plurality of teeth found on either forming ring (see in particular FIG. 12). In the extended position the central pushing member 41 not only serves to remove the wire W from forming dog 32 but also retains the wire W in contact with the small tooth of one of the forming rings until the forming dog 32 is out of the way and enough tension has been placed on the wire W so that it remains on the teeth of the forming ring without support from central pushing member 41. This is an important function of central pushing member 41 as it replaces what formerly were a variety of mechanical holding means which were both cumbersome and expensive.

Outside pushing member 42 is in turn actuated by an eccentric crank 43 (see in particular FIG. 1). Eccentric crank 43 operates to provide a discontinuous arcuate motion to outside pushing member 42. Outside pushing member 42 serves to remove the wire W which is wrapped around forming dog 32 when next to outside pushing member 42 (see FIG. 11). During at least a portion of its rotational movement forming arm 31 and forming dog 32 are in position immediately adjacent outside pushing member 42. At this point the outside surface 45 of one of the forming dogs 32 is abutting the inside surface 46 of outside pushing member 42. Thus by predetermined arcuate movement in a forward manner the outside pushing member 42 pushes the wire from forming dog 32 onto the large pin of one of the forming rings of the wire stretching assembly 60. As with central pushing member 41 outside pushing member 42 also has an extended (FIG. 11) and retracted (FIGS. 10 and 12) position. In the extended position outside pushing member 42 holds the wire W in place until forming dog 32 has been rotated out of the way.

Thus the wire pushing assembly 40 which comprises a central pushing member 41 and an outside pushing member 42 is aligned with and operates in a cooperative relationship with the wire looping assembly 30 and more particularly forming arm 31 and forming dogs 32 to translate a linear strand of wire W into a looped strand of wire held by frictional forces on wire stretching assembly 60. The central pushing member 41 transfers the wire W to the small toothed forming ring while the outside pushing member 42 transfers the wire W to the large toothed forming ring. In general the outside pushing member 42 operates slightly later than the central pushing member 41 although the precise timing is controlled by rotating cams located as the posterior portion of gear and drive mechanism 35.

The wire stretching assembly comprises essentially a small pin forming ring 61 fixedly attached by conventional fastening means to a rotatable wheel 63 together with a large pin forming ring 62 attached to a second rotatable wheel 64. More specifically, and as best shown in FIGS. 5 and 8 the pair of rotatable wheels 63 and 64 are rotatably mounted about axes 65 and 66 respectively. As may be best understood from FIG. 5, the axes 65 and 66 are angularly disposed with respect to each other, it being apparent, particularly from FIG. 5, that the axes indicated by the center lines 65 and 66 are disposed in a vertical plane with their point of intersection constituting a vertex.

A plurality of small radial pins 67 are disposed about the periphery of forming ring 61 while a plurality of radial pins 68 are disposed about the periphery of forming ring 61. The pins such as 67 are individually staggered relative to the pins such as 68 to facilitate looping of the wire into the configuration shown in FIG. 8. It can be easily appreciated that the forming rings 61 and 62 are difficult to machine. In previous attempts to machine forming rings 61 and 62 they were generally made in two equal halves which were then joined. This procedure avoided some of the problems associated with the machining of the forming rings but at the same time introduced a potential error in that the joined halves were difficult to join into a perfect circle. It has been established that the tolerance for error in forming rings 61 and 62 is very low and as a solution to this problem forming rings of a generally smaller overall diameter, say from about 4 inches to about 20 inches have been used. The use of smaller forming rings permits the tooling and machining of the forming rings as a single circular piece as opposed to the previous two piece construction.

From the above description and particularly from FIG. 5, it is apparent that the pins 67 are spaced a maximum lateral distance from the pins 68 when particular pins occupy their uppermost positions such for example as that immediately below the uppermost positions. When the pins occupy the diametrically opposite or lowermost position they are disposed at a minimum lateral spacing from each other while points in between constitute points of intermediate spacing. In this fashion the wheels 63 and 64 and forming rings 61 and 62 are rotatably mounted on axes 65 and 66 which are angularly disposed so that a plurality of pins 67 and 68 disposed about the peripheries of both of said forming rings 61 and 62 are caused to occupy spaced relationships which continuously vary throughout each revolution of the wire stretching assembly 60. This space variation allows rapid formation of loops of wire about the pins 67 and 68 followed by a tightening of the loops due to increased spacing between a particular pin 67 on forming ring 61 and the adjacent pin 68 on forming ring 62. Thus a permanent set is imparted to the wire according to a feature of the invention.

A wire removal member 69 is aligned between forming rings 61 and 62 to insure removal of the stretched and formed wire W so that the wire may be fed into wire feed assembly 70 and wire press assembly 80. There are a variety of mechanical equivalents to wire removal member 69 equally functional.

From the above description it is apparent that the removal of the formed wire occurs near the minimum spacing whereas the looping operation occurs where the spacing is intermediate maximum and minimum as is represented by the part of the wire immediately adjacent to the wire looping assembly 30 and the wire pushing assembly 40. Of course the wire is tightened as the wheel rotates clock-wise as viewed in FIG. 1 from a position adjacent wire looping assembly 30 to a maximum tension at the highest point of rotation of forming ring 61 and 62 designated by the number 52 as shown more clearly in FIG. 1 with appreciably shifting the loops along the length of the strand.

Figure 2:
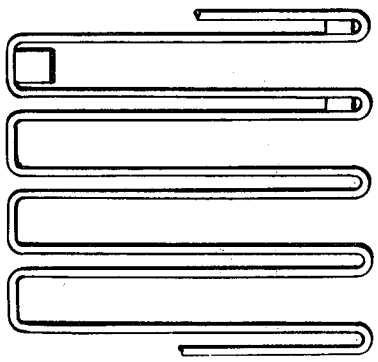
FIG. 2 is a view of a strand of wire formed into a particular configuration by the invention; sometimes referred to herein as a zig-zag configuration.
Figure 3:
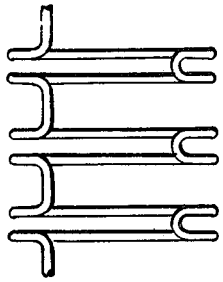
FIG. 3 is a view of a formed portion of wire such as is shown in FIG. 2 after a subsequent bending operation has been imparted thereto.
Figure 4:
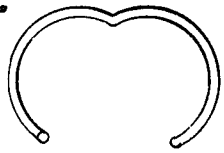
FIG.4 is an end view of the wire shown in FIG. 3.
Figure 13:
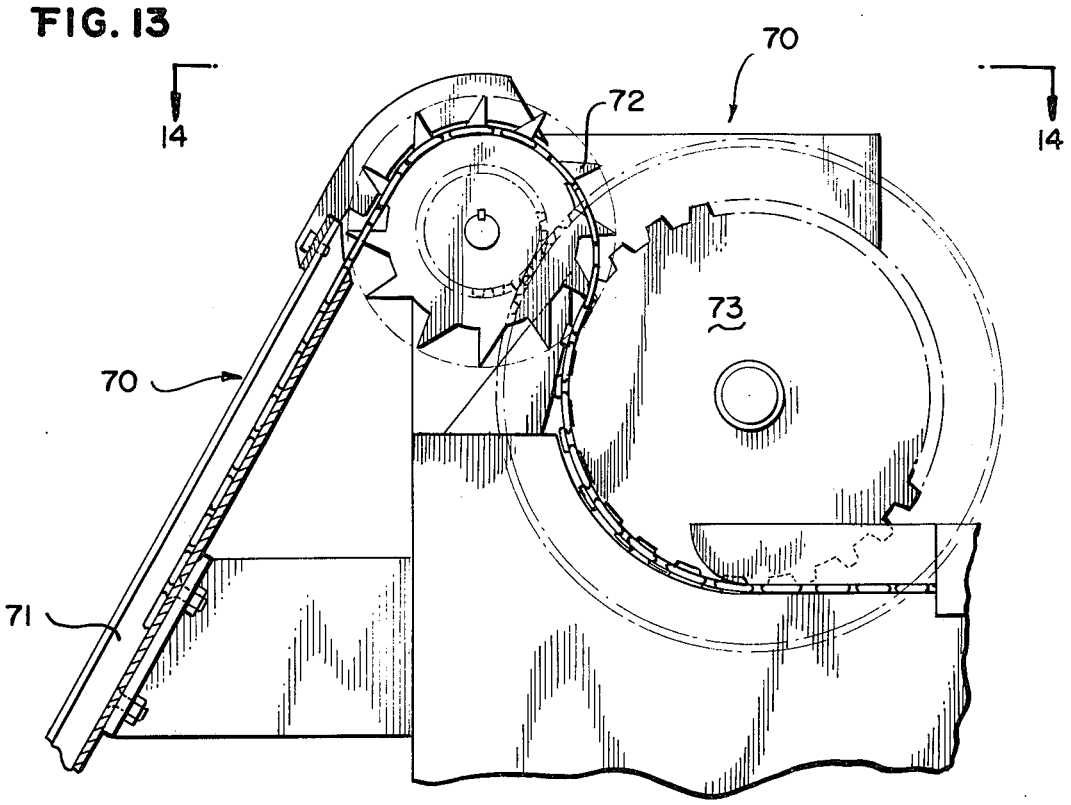
FIG. 13 is a schematic front view of the wire feed assembly of this invention.
Figure 14:
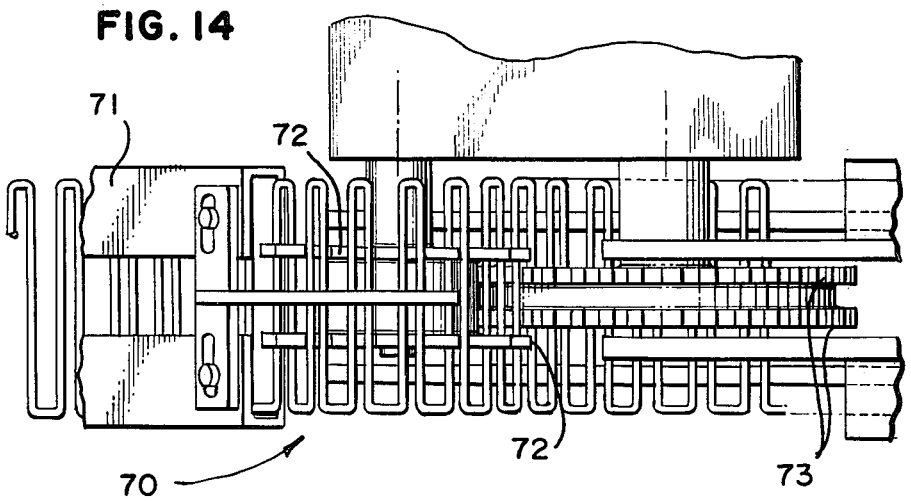
FIG. 14 is top view of the wire feed assembly as shown in FIG. 13 taken along line 14—14 in FIG. 13 and viewed in the direction of the arrows.
Figure 15:
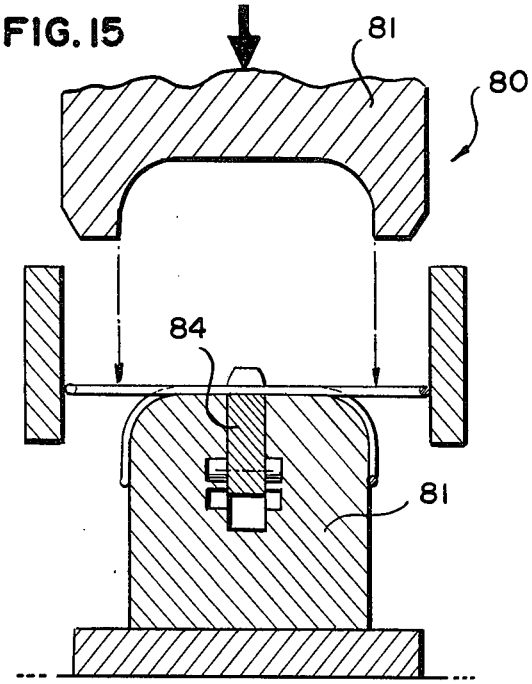
FIGS. 15 and **15*a* are cross sectional views of the first die stage of the wire press assembly of this invention prior to (FIG. 15) and after (FIG. 15*a*)the wire is formed into the preliminary arcuate configuration taken along line 15—15 of FIG. 1**.
Figure 15A:
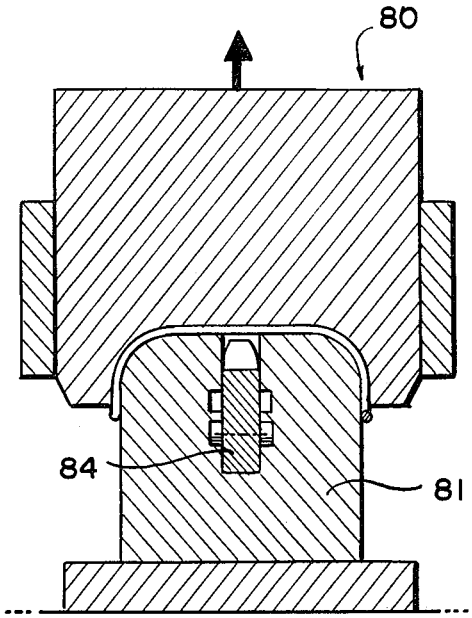
Figure 16:
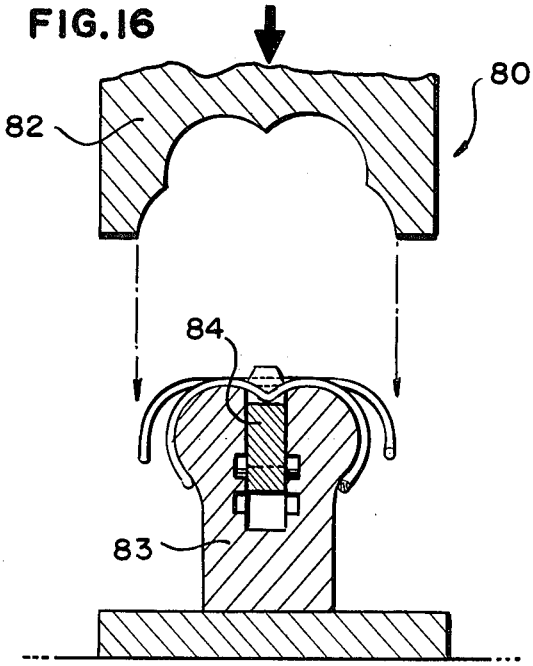
FIGS. 16 and **16*a* are substantially identical to FIGS. 15 and 15*a*, respectively, with the exception that FIGS. 16 and 16*a* are taken along line 16—16 of FIG. 1** and illustrate the action of the second die stage.
Figure 16A:
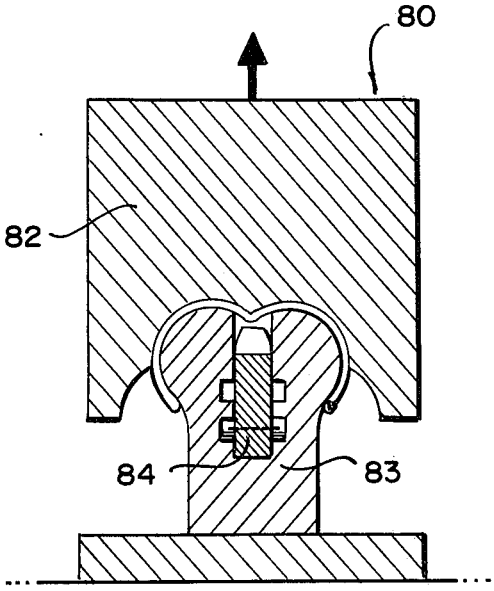

From the wire stretching assembly the wire is removed in a planar zig-zag configuration as shown more particularly by FIG. 2. It is desirable to convert this planar configuration into an arcuate configuration of FIGS. 3 and 4. In order to do this a wire press assembly 80 is used. In order to feed the wire into wire press assembly 80 a wire feed assembly 70 is provided which maintains the desirable configuration of the planar wire as is shown more particularly by FIG. 13.

The wire feed assembly includes a wire infeed ramp 71 which is configured to confine movement of planar wire W to prohibit stretching of said wire W. From the wire infeed ramp 71 the wire is grasped by a pair of aligned star wheels 72 which in turn feed the wire W into feed wheel 73. Feed wheel 73 provides the means for feeding the planar, zig-zag wire into wire press assembly 80 which comprises a first dye stage 81 and a second dye stage 82.

Guide means 83 and wire feed rack 84 are used to transfer the zig-zag wire through dye stages 81 and 82. Upon exiting from the dye stage 82 the zig-zag wire has been shaped into an arcuate form which permits insertion and fastening into a variety of paper notebook products.

While the invention has been illustrated and described in detail in the drawings and the foregoing descriptions, the same is to be considered as illustrative and not restrictive in character, it being understood that only the preferred embodiment has been shown and described and that all changes and modifications that come within the spirit of the invention are desired to be protected.

The invention claimed is:

1. In a wire forming apparatus of the type wherein a pair of rotatable wheels are disposed alongside each other, a plurality of pins secured to each of said wheels about the periphery thereof, and mounting means for rotatably supporting said wheels in such a manner that their axes of rotation are angularly disposed to each other, wherein the improvement comprise:

a. looping means disposed adjacent the peripheries of said wheels, said looping means being discontinuously rotatable in a single direction about a central axis, said central axis of said looping means being offset from and parallel to a plane defined by said plurality of pins secured to either of said wheels about the periphery thereof, said looping means intermittently engaging a strand of wire and imparting an undulatory configuration thereto; and b. pushing means integrally disposed adjacent said looping means for transferring a looped strand of wire from said looping means to one of said pins on one of said wheels, said pushing means comprising at least two individual pushing members, said pushing means and said looping means being aligned and operating in cooperative relationship with one another.

2. The wire forming apparatus of claim 1 wherein said looping means are disposed adjacent the peripheries of said wheels at a position at which the adjacent pins of one wheel are spaced axially from the adjacent pins of the other wheel by a distance intermediate the maximum and minimum axial spacing between said pins whereby rotation of said wheels imparts a tension force to the strand of wire to cause the wire to become stretched and set without appreciably changing the initial disposition of the strand of wire relative to said pins and without shifting the undulations along the length of said strand.

3. The wire forming apparatus of claim 1 further comprising a wire feed assembly for use in introducing said strand of wire into said looping means, said wire feed assembly including:

a. wire tension means affording an adjustable frictional drag resistance against the feeding of said strand of wire so as to facilitate the looping of said strand of wire; and b. wire straightening means to facilitate the linear configuration of said strand of wire prior to said introduction into said looping means.

4. The wire forming apparatus of claim 1 wherein said pushing means comprise:

a. an inside pushing member for transferring said strand of wire from said looping means to one of said pins on a first rotatable wheel of said pair of rotatable wheels, said inside pushing member being actuated by cam means to provide predetermined reciprocal movement to said inside pushing member; and b. an outside pushing member for transferring said strand of wire from said looping means to one of said pins on a second rotatable wheel of said pair of rotatable wheels, said outside pushing members being actuated by an eccentric crank to provide predetermined arcuate movement to said outside pushing member, said inside and outside pushing members operating intermittently in cooperating relationship with each other.

5. In a wire forming apparatus of the type wherein a pair of rotatable wheels are disposed alongside each other, a plurality of pins secured to each of said wheels about the periphery thereof, and mounting means for rotatably supporting said wheels in such a manner that their axes of rotation are angularly disposed to each other, wherein the improvement comprises:

a. wire tension means affording an adjustable frictional drag resistance against the feeding of a strand of wire so as to facilitate the looping of said strand of wire;

b. wire straightening means to facilitate the linear configuration of said strand of wire prior to the introduction of said wire into the looping means;

c. looping means disposed adjacent the peripheries of said wheels at a position at which the adjacent pins of one wheel are spaced axially from the adjacent pins of the other wheel by a distance intermediate the maximum and minimum axial spacing between said pins whereby rotation of said wheels imparts a tension force to the strand of wire to cause the wire to become stretched and set without appreciably changing the initial disposition of the strand of wire relative to said pins and without shifting the undulations along the length of said strand, said looping means being discontinuously rotatable in a single direction about a central axis, said central axis of said looping means being offset from and parallel to a plane defined by said plurality of pins secured to either of said wheels about the periphery thereof, said looping means intermittently engaging said strand of wire and imparting an undulatory configuration thereto;

d. an inside pushing member for transferring said strand of wire from said looping means to one of said pins on a first rotatable wheel of said pair of rotatable wheels, said inside pushing member being actuated by cam means to provide predetermined reciprocal movement to said inside pushing member; and e. an outside pushing member for transferring said strand of wire from said looping means to one of said pins on a second rotatable wheel of said pair of rotatable wheels, said outside pushing member being actuated by an eccentric crank to provide predetermined arcuate movement to said outside pushing member, said inside and outside pushing members operating intermittently in cooperating relationship with each other.

* * * * *